US006521084B1

(12) United States Patent
Burger et al.

(10) Patent No.: US 6,521,084 B1
(45) Date of Patent: Feb. 18, 2003

(54) CHEMICAL DIGESTION PROCESS USING ORGANOSILOXANE COMPOUNDS

(75) Inventors: Willibald Burger, Elisabethstrasse (DE); Outi Neubig, Schmied-Kochel-Str. (DE); Kimmo Lappalainen, Korsitie (FI); Hannu Wahlberg, Ukonkellonkatu (FI)

(73) Assignee: Wacker-Chemie GmbH, Munich (DE)

( * ) Notice: Subject to any disclaimer, the term of this patent is extended or adjusted under 35 U.S.C. 154(b) by 695 days.

(21) Appl. No.: 08/836,009

(22) PCT Filed: Nov. 9, 1995

(86) PCT No.: PCT/EP95/04411

§ 371 (c)(1),
(2), (4) Date: Jun. 27, 1997

(87) PCT Pub. No.: WO96/15312

PCT Pub. Date: May 23, 1996

(30) Foreign Application Priority Data

Nov. 9, 1995 (DE) ..... 44 40 186

(51) Int. Cl.[7] ..... D21C 3/20
(52) U.S. Cl. ..... 162/72; 162/76; 162/80

(58) Field of Search ..... 162/72, 80, 76

(56) References Cited

U.S. PATENT DOCUMENTS

| | | | | |
|---|---|---|---|---|
| 3,147,179 A | * | 9/1964 | Simmons et al. | 162/76 |
| 3,909,345 A | | 9/1975 | Parker et al. | |
| 4,477,371 A | | 10/1984 | Huber et al. | |
| 5,250,152 A | | 10/1993 | Ling et al. | |

FOREIGN PATENT DOCUMENTS

| | | |
|---|---|---|
| EP | 0106209 | 4/1984 |
| EP | 0612759 | 8/1994 |
| GB | 951325 | 3/1964 |

OTHER PUBLICATIONS

English translation for EP 0612759.

* cited by examiner

*Primary Examiner*—Steve Alvo
(74) *Attorney, Agent, or Firm*—Brooks & Kushman P.C.

(57) ABSTRACT

In a process for extracting cellulose from fibrous materials such as wood, the fibrous materials are reacted with a chemical disintegration solution in the presence of organosilicic compounds.

5 Claims, No Drawings

CHEMICAL DIGESTION PROCESS USING ORGANOSILOXANE COMPOUNDS

The invention relates to a process for producing pulp from fibrous materials, wherein organosilicon compounds are added to the chemical digestion process.

The cellulose fibers and hemicellulose fibers contained in fibrous materials such as wood are held together by lignin, a polymer composed of hydroxyphenylpropane units. The production of pulp, a more or less impure cellulose, involves a separation of lignin from the cellulose. By far the most important process for producing pulp from fibrous material is the process known as the alkaline sulfate process or Kraft process, in which lignin is leached from the fibrous material by an aqueous digesting solution which as its main components contains NaOH and $Na_2S$.

One option of increasing the pulp yield in chemical digestion processes is to add organic surfactants. For example, U.S. Pat. No. 3,909,345 discloses the use of ethylene oxide/propylene oxide block copolymers and U.S. Pat. No. 5,250,152 discloses the use of ethoxylated alcohols and ethoxylated dialkylphenols in the alkaline sulfate process.

It is an object of the invention to provide an improved process for producing pulp from fibrous materials via a chemical digestion process.

The invention relates to a process for producing pulp from fibrous materials, wherein the fibrous materials are reacted with a chemical digesting solution in the presence of organosilicon compounds.

For a given residual lignin content in the pulp, the novel process requires less digesting solution. One measure for the residual lignin content in pulp is the kappa number which corresponds to the consumption of milliliters of 0.1 normal (3.161 g/l) potassium permanganate solution per gram of pulp.

Reducing the amount of digesting solution increases the pulp yield, based on fibrous material used, since smaller amounts of carbohydrates, in particular hemicelluloses, are leached out and therefore smaller amounts of by-products are formed.

If the organosilicon compounds are used, a specific kappa number can also be achieved by the cooking time being shortened.

In the process according to the invention, the kappa number is lowered under constant digestion conditions.

Since the digesting solution now acts to better effect, the pulp contains a smaller amount of relatively coarse, undigested raw fibrous materials ("rejects").

In general, organosilicon compounds result in a higher pulp yield and smaller amounts of undigested fibrous materials.

The organosilicon compounds also improve the mechanical strength factors of pulp and reduce the degradation of cellulose.

Preferred organosilicon compounds are organic siloxanes and silanes which contain an organic polar group and a hydrophobic siloxane moiety or silane moiety and consequently have interface-active characteristics at the phase boundaries liquid/liquid, liquid/gaseous and liquid/solid.

Preferred organosilicon compounds are the organopolysiloxane compounds which are composed of units of the general formulae (I) to (VII)

| | |
|---|---|
| $R_3SiO_{1/2}$ | (I), |
| $R_2SiO$ | (II), |
| $RSiO_{3/2}$ | (III), |
| $SiO_{4/2}$ | (IV), |
| $R_2R'SiO_{1/2}$ | (V), |
| $RR'SiO$ | (VI), |
| $R'SiO_{3/2}$ | (VII), |

where

R represents univalent hydrocarbon radicals having from 1 to 18 carbon atoms,

R' represents univalent radicals of the general formulae (VIII), (IX), (X) or (XI)

$$-R^1-[O(CR^2)_a]_bOR^3, \quad \text{(VIII)}$$

$$-(R^1-)_cC(=HC)-[O(CR^2)_a]_bOR^3, \quad \text{(IX)}$$

$$-R^1-[O(CR^2)_a]_bZ, \quad \text{(X)}$$

$$-R^1-[NR^2(CH_2)_a]_dNHR^2, \quad \text{(XI)}$$

in which $R^1$ represents divalent $C_1$- to $C_{18}$-hydrocarbon radicals, $R^2$ represents hydrogen atoms or univalent $C_1$- to $C_6$-alkyl radicals, $R^3$ represents hydrogen atoms, univalent $C_1$- to $C_6$-acyl radicals, $C_1$- to $C_6$-hydrocarbon radicals, or $OSO_3X$, X represents hydrogen atoms, alkali metal ions or ammonium ions which may or may not be substituted by $C_1$- to $C_{18}$-hydrocarbon radicals, Z represents glycosidyl radicals composed of from 1 to 10 monosaccharide units, a represents the values 1, 2, 3, 4 or 5, b represents integer values from 0 to 200, c represents the values 0 or 1 and d represents the values 0, 1, 2, 3 or 4, with the proviso that the organopolysiloxane compounds have at least one unit of the general formulae (V) to (VII).

Likewise preferred organosilicon compounds are the organosilanes of the general formula (XII).

$$R_3SiR' \quad \text{(XII)}$$

in which

R' represents univalent radicals of the abovementioned general formula (VIII) and R has the abovementioned meanings.

If b in the general formulae (VIII) to (XI) has a value of at least 2, a may adopt various values within the scope of the formula $[O(CR^2)_a]_b$ of a radical. For example, the scope of the formula $[O(CR^2)_a]_b$ may represent a polyethylene glycol/polypropylene glycol block copolymer.

Examples of hydrocarbon radicals R are alkyl radicals such as the methyl, ethyl, n-propyl, isopropyl, n-butyl, isobutyl, t-butyl, n-pentyl, isopentyl, neopentyl, t-pentyl radical; hexyl radicals such as the n-hexyl radical; heptyl radicals such as the n-heptyl radical; octyl radicals such as the n-octyl radical and isooctyl radicals such as the 2,2,4-trimethylpentyl radical; nonyl radicals such as the n-nonyl radical; decyl radicals such as n-decyl radical; dodecyl radicals such as the n-dodecyl radical; octadecyl radicals such as the n-octadecyl radical; alkenyl radicals such as the vinyl, allyl and the 5-hexen-1-yl radical; cycloalkyl radicals such as cyclopentyl, cyclohexyl, cycloheptyl radicals and methylcyclohexyl radicals; aryl radicals such as the phenyl, naphthyl and anthryl and phenanthryl radical; alkaryl radicals such as o-, m-, p-tolyl radicals, xylyl radicals and ethylphenyl radicals; aralkyl radicals such as the benzyl radical, the α- and the β-phenylethyl radical.

Preferably, at least 90 mol % of the radicals R are methyl, ethyl or phenyl radicals, especially methyl radicals.

Examples of the divalent radicals $R^1$ are saturated straight-chain or branched or cyclic alkylene radicals such as the methylene and ethylene radical and also propylene, butylene, pentylene, hexylene, 2-methylpropylene, cyclohexylene radicals, or unsaturated alkylene or arylene radicals such as the hexenylene radical and phenylene radicals.

Examples of the monovalent alkyl radicals $R^2$ and $R^3$ are listed. under the abovementioned examples of R.

Examples of the hydrocarbon radicals on the ammonium ions in X are the hydrocarbon radicals mentioned for R.

Examples of the $C_1$- to $C_6$-acyl radicals $R^3$ are the acetyl, propionyl and n-butyryl radical.

Examples of monosaccharides of which the glycoside radicals Z may be composed are hexoses and pentoses such as glucose, fructose, galactose, mannose, talose, allose, altrose, idose, arabinose, xylose, lyxose and ribose, glucose being particularly preferred. Preferably, the glycoside radicals Z contain one or two monosaccharide units.

Preferably, a represents the values 2 or 3. Preferably, b represents integer values from 3 to 100, especially from 10 to 70.

Preferably, from 2 to 50% , especially from 5 to 20% of the units of the organopolysiloxane compound have the general formulae (V) to (VII).

Preferably, at least 95% , especially at least 99% of the units of the organopolysiloxane compound are units of the general formulae (II), (VI) and (I). It is also preferred for the organopolysiloxane compound to have an average viscosity of from 20 to 500,00.0 mPa·s, especially from 200 to 60,000 mPa·s at 25° C.

One organosilicon compound or alternatively mixtures of a plurality of organosilicon compounds can be used.

Preferably, from 0.001 to 1, especially from 0.01 to 0.1 part by weight of organosilicon compounds is used per 100 parts by weight of dry fibrous materials.

Examples of chemical digestion processes which can be used are:

1) The Sulfite Process

The sulfite digestion involves cooking chips with solutions of hydrogen sulfites. Depending on whether the hydrogen sulfite solutions do or do not contain excess sulfur dioxide, the processes are referred to as acid bisulfite processes or simply as bisulfite processes. These are subsumed under the widely established term "sulfite process".

2) The Sulfate Process

In the sulfate process the digesting solution, which is also referred to as white liquor, comprises the main components NaOH and $Na_2S$.

The sulfate process is preferred.

If the alkaline sulfate process is used, the process preferably employs from 10 to 35, especially from 20 to 30 parts by weight of $Na_2O$ in the form of NaOH per 100 parts by weight of dry wood. The process preferably employs from 3 to 15, especially from 6 to 10 parts by weight of $Na_2S$ per 100 parts by weight of dry wood. The process is preferably carried out at from 0.1 to 3 MPa, especially from 0.5 to 1.5 MPa.

The chemical processes can be carried out batchwise or continuously in a pulp digester.

The residence time of the mixture in the pulp digester is preferably from 10 min to 7 h.

Examples of fibrous materials to be used include all those vegetable raw materials (fibrous plants) which have an adequate cellulose content and can be processed with sufficient ease.

Preference is given to the use of wood, one of the raw materials used these days in large amounts in many countries being the wood waste produced in the sawmills. In addition, however, certain annual plants and grasses also play a subordinate part. The wood is used in the form of, for example, chips, shavings or wood dust.

In the following examples, unless stated otherwise, a) all the amounts given relate to weight;

b) all pressures are 0.10 MPa (abs.);

c) all temperatures are 20° C.

d) EO is an ethylene ether unit (—$CH_2CH_2$—O—).

EXAMPLES

Example 1

Pulp digestion in a continuous pulp digester

The organosilicon compound used was a water-soluble silicone surfactant containing polyglycol ether functions (Pulpsil®950 S from Wacker-Chemie GmbH, Munich). Pulpsil® 950 S is prepared by a reaction of the organosiloxane compound of formula (XIII)

$$(H_3C)_3SiO[(H_3C)_2SiO]_{75}[HCH_3SiO]_5Si(CH_3)_3 \quad \text{(XIII)}$$

with the allyl polyglycol of formula (XIV)

$$H_2C{=}CH{-}CH_2{-}O[CH_2CH_2O]_{25}[CH_2CH(CH_3)O]_{25}H \quad \text{(XIV)}$$

in the presence of a platinum catalyst. The organosilicon compound formed in the process is characterized by formula (XV)

$$(H_3C)_3SiO[(H_3C)_2SiO]_{75}[Y(CH_3)SiO]_5Si(CH_3)_3 \quad \text{(XV)}$$

where Y has the formula (XVI)

$$-(H_2C)_3O[CH_2CH_2O]_{25}[CH_2CH(CH_3)O]_{25}H \quad \text{(XVI).}$$

A continuous pulp digester having a capacity of 270 metric tons of dry wood substance in the form of sawdust per day was operated at 172° C. and 0.95 MPa. The residence time of the mixture in the digester was 15 minutes. The process employed 28 parts by weight of $Na_2O$ and 7 parts by weight of $Na_2S$ per 100 parts by weight of dry wood. The pulp obtained had a kappa number of about 52.

After 36 hours, 0.022 parts by weight of the abovementioned organosilicon compound per 100 parts by weight of dry wood substance were additionally introduced continuously into the digesting solution immediately upstream of the digester, whereupon the kappa number of the pulp dropped to about 48.

Then the amount of $Na_2O$ was reduced to 25 parts by weight per 100 parts by weight of dry wood. The pulp obtained once more had a kappa number of about 52.

Example 2

Pulp Digestion Experiments in the Laboratory

The pulp digestion experiments described below, in the presence of organosilicon compounds in the laboratory, likewise demonstrate the efficacy of these compounds in the production of pulp.

Digestion Conditions for the Laboratory Experiments

Laboratory digester:

Pulp digester in which 6 autoclaves, each having a volume of 2.5 l, can be operated simultaneously under identical conditions.

Types of wood:

Coniferous wood: Pine ("Scots pine", pinus silvestris) from eastern Finland;

Deciduous wood: Birch ("Betula birch")from a Finnish pulp mill

Amount of wood chips weighed in:

300 g of wood chips, oven-dried in accordance with test method SCAN-CM 39:38

Effective alkali:

(as NaOH in %, based on dry weight of wood chips) 20% for deciduous wood, or 21% for coniferous wood (in accordance with test method SCAN-N 2:88)

Sulfidity: 32%

(in accordance with test method SCAN-N 2:88)

Ratio of cooking liquor/wood:

5:1, including the water content of the wood chips

Amount of surface-active compounds added:

0.04% , based on dry weight of wood substance

Heating-up time:

The time required for moving from 80° C. to 161° C. in the case of deciduous wood or 173° C. in the case of coniferous wood; the precise data are listed in the table.

Residence time:

The period during which the digestion of the wood chips in the autoclave of the pulp digester takes place after the end temperature 161° C. in the case of deciduous wood and 173° C. in the case of coniferous wood has been reached; the exact data are listed in the table.

General Description of the Laboratory Trials

The wood chips, which had initially been frozen after delivery, were thawed out again over a period of 48 h.

By careful screening they were then separated into various fractions, whose dry weight was determined in accordance with SCAN-CM 39:38 (24 h, 105° C.). The subsequent digestion of the wood chips in each case involved a defined composition from the fractions of the screening.

To this end the autoclave was charged each time with 300 g of wood chips—based on the dry weight—to which white liquor (the actual cooking liquor as the digesting solution which, as the main components, contains NaOH and $Na_2S$) and black spent liquor (the filtrate from pulp washing, said filtrate containing NaOH and $Na_2S$ in dilute form) from a Finnish pulp mill were added, so as to set the abovementioned digestion conditions (effective alkali, liquid/wood ratio, sulfidity).

Then 0.04% of the surface-active compounds mentioned in the table were added as 2% strength solutions in distilled water.

After cooking had finished, the pulp from the 6 autoclaves at a time was washed (for 16 h with warm water of about 45° C.), centrifuged and homogenized.

This was followed by the determination of the total yield of pulp, prior to defibration for 10 min in a Wennberg defibrator and renewed screening via a 0.35 mm mesh screen (Mantta̤ screen) to determine the proportion of undigested fibrous materials (rejects).

The yield of screened pulp (total yield minus rejects) was given in percent, based on the amount weighed in of oven-dried wood chips.

Description of the Surfactants Used

Surfactants used

The following products were used as organosilicon surfactants:

1. Silicone oil Wacker® LO66 (from Wacker-Chemie GmbH Munich)

Silicone oil Wacker® LO66 is prepared by a reaction of the organosilicon compound of the formula (XVII)

$$H_3CSiO[Si(CH_3)HO]_{1.4}SiCH_3 \quad \text{(XVII)}$$

with the allyl polyglycol of the formula (XVIII)

$$H_2C{=}CH{-}CH_2O[CH_2CH_2O]_{6.5}CH_3 \quad \text{(XVIII)}$$

in the presence of a platinum catalyst. The organosilicon compound formed in the process is characterized by the formula (IXX)

$$H_3CSiO[Si(CH_3)YO]_{1.4}SiCH_3 \quad \text{(IXX)}$$

where Y has the formula (XX)

$$(CH_2)_3O[CH_2CH_2O)_{6.5}CH_3 \quad \text{(XX).}$$

2. Wacker® SPG 120 VP (from Wacker-Chemie GmbH, Munich)

Wacker® SPG 120 VP is a 50% strength solution of a siloxane-modified glycoside in water/isopropanol, the active ingredient being prepared by the reaction of the organosiloxane compound of the formula (XVII) with the allyl polyglycol of the formula (XXI)

$$H_2C{=}CH{-}CH_2O[CH_2CH_2O]_1\text{-(glycosidyl)}_{1,8} \quad \text{(XXI)}$$

in the presence of a platinum catalyst.

The organosilicon compound produced in the process is characterized by the formula (IXX), Y having the formula (XXII)

$$(CH_2)_3O(CH_2CH_2O)_1(\text{glycosidyl})_{1,8} \quad \text{(XXII).}$$

The organic surfactants B1 and B2, described in U.S. Pat. No. 5,250,152, were used for comparison.

3. Organic Surfactant B1

The organic surfactant B1 is a 1:1 mixture of ethoxylated isostearyl alcohol (isostearyl $(EO)_{10}OH$) and ethoxylated oleyl alcohol (oleyl$[EO]_{20}OH$].

4. Organic Surfactant B2

The organic surfactant B2 is a 1:1 mixture of di-n-nonylphenol ethoxylates containing various proportions of EO. The two phenol derivatives are characterized by the formulae (XXIII) and (XXIV).

(XXIII)

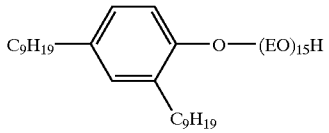

(XXIV)

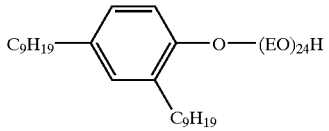

Results of the Pulp Digestion Experiments in the Laboratory 3 pulp digestion experiments were carried out in the above-described pulp digester, using the organosilicon surfactants and the purely organic surfactants B1 and B2 under various conditions.

In all the cooking trials, digestion with the silicone surfactant SPG 120 VP resulted in the highest yields of screened pulp.

In addition, the laboratory trials using LO66 resulted in pulp qualities having the lowest kappa numbers and relatively low "rejects".

TABLE

| No. of pulp cooking trial | Surfactants | Amount of surfactant added, in % | Kappa number | Pulp yield after screening, in % | Rejects in % | Effective alkali as g of NaOH/100 g of dry wood sub-stance | Type of wood | Heating time in min | Residence time in min |
|---|---|---|---|---|---|---|---|---|---|
| 1 | — | 0 | 22.5 | 53.3 | 0.7 | 20 | Deciduous wood | 39 | 62 |
| | L 066 | 0.04 | 21.8 | 54.9 | 0.6 | | | | |
| | SPG 120 VP | 0.04 | 23.7 | 55.9 | 0.7 | | | | |
| | B1 | 0.04 | 23.0 | 54.6 | 0.6 | | | | |
| | B2 | 0.04 | 22.7 | 54.5 | 1.1 | | | | |
| 2 | — | 0 | 17.0 | 53.7 | — | 20 | Deciduous wood | 35 | 174 |
| | L 066 | 0.04 | 16.0 | 54.1 | — | | | | |
| | SPG 120 VP | 0.04 | 16.2 | 54.4 | 0.04 | | | | |
| | B1 | 0.04 | 16.4 | 53.9 | 0.01 | | | | |
| | B2 | 0.04 | 17.4 | 53.6 | — | | | | |
| 3 | — | 0 | 27.4 | 47.8 | 0.5 | 21 | Coniferous wood | 49 | 65 |
| | L 066 | 0.04 | 27.1 | 48.5 | 0.6 | | | | |
| | SPG 120 VP | 0.04 | 30.0 | 48.9 | 0.8 | | | | |
| | B1 | 0.04 | 27.3 | 47.3 | 0.5 | | | | |
| | B2 | 0.04 | 29.8 | 47.9 | 0.5 | | | | |

What is claimed is:

1. A process for producing pulp from fibrous materials, wherein the fibrous materials are reacted with a chemical digesting solution in the presence of organosilicon compounds which are selected from organopolysiloxane compounds comprising units of the general formulae (I) to (VII)

| | |
|---|---|
| $R_3SiO_{1/2}$ | (I), |
| $R_2SiO$ | (II), |
| $RSiO_{3/2}$ | (III), |
| $SiO_{4/2}$ | (IV), |
| $R_2R'SiO_{1/2}$ | (V), |
| $RR'SiO$ | (VI), |
| $R'SiO_{3/2}$ | (VII), |

where

R is a monovalent hydrocarbon radical having from 1 to 18 carbon atoms,

R' is a monovalent radical of the general formulae (VIII), (IX), (X) or (XI)

$$—R^1—[O(CR^2)_a]_bOR^3, \quad (VIII)$$

$$—(R^1—)_cC(=HC)—[O(CR^2)_a]_bOR^3, \quad (IX)$$

$$—R^1—[O(CR^2)_a]_bZ, \quad (X)$$

$$—R^1—[NR^2(CH_2)_a]_dNHR^2, \quad (XI)$$

in which $R^1$ is a divalent $C_1$- to $C_{18}$-hydrocarbon radical $R^2$ is a hydrogen atom or a monovalent $C_1$- to $C_6$-alkyl radical, $R^3$ is a hydrogen atom, a monovalent $C_1$- to $C_6$-acyl radical, $C_1$- to $C_6$-hydrocarbon radical, or $OSO_3X$, X is a hydrogen atom, alkali metal ion or ammonium ion which is optionally substituted by $C_1$- to $C_{18}$-hydrocarbon radicals, Z is a glycosidyl radical composed of from 1 to 10 mono saccharide units, a has a value 1, 2, 3, 4 or 5, b has a value from 0 to 200, c has a value 0 or 1 and d has a value 0, 1, 2, 3 or 4, with the proviso that the organopolysiloxane compounds have at least one unit of the general formulae (V) to (VII), or from organosilanes of the general formula (XII)

$$R_3SiR' \quad (XII)$$

in which

R' is a monovalent radical of general formula (VIII) and

R is a monovalent hydrocarbon radical having from 1 to 18 carbon atoms.

2. The process as claimed in claim 1, wherein at least 95% of the units of the organopolysiloxane comprise units of one or more of the general formulae (II), (VI) and (I).

3. The process as claimed in claim 1, wherein from 0.001 to 1 part by weight of organosilicon compound is present per 100 parts by weight of dry fibrous materials.

4. A process for producing pulp from fibrous materials, wherein the fibrous materials are reacted with a chemical digesting solution in the presence of organosilicon compounds which are selected from organopolyisloxane compounds comprising units of the general formulae (I) to (VII)

| | |
|---|---|
| $R_3SiO_{1/2}$ | (I), |
| $R_2SiO$ | (II), |
| $RSiO_{3/2}$ | (III), |
| $SiO_{4/2}$ | (IV), |
| $R_2R'SiO_{1/2}$ | (V), |
| $RR'SiO$ | (VI), |
| $R'SiO_{3/2}$ | (VII), |

R is a monovalent hydrocarbon radical having from 1 to 18 carbon atoms,

R' is a polyoxyalkylene species selected from the group consisting of (VIII), (IX), and (X)

$$-R^1-[O(CR^2)_a]_bOR^3, \quad \text{(VIII)}$$

$$-(R^1-)_cC(=HC)-[O(CR^2)_a]_bOR^3, \quad \text{(IX)}$$

$$-R^1-[O(CR^2)_a]_bZ, \quad \text{(X)}$$

in which $R^1$ is a divalent $C_1$- to $C_{18}$-hydrocarbon radical $R^2$ is a hydrogen atom or a monovalent $C_1$- to $C_6$-alkyl radical, $R^3$ is a hydrogen atom, monovalent $C_1$- to $C_6$-acyl radical, $C_1$- to $C_6$-hydrocarbon radical, or $OSO_3X$, X is a hydrogen atom, alkali metal ion or ammonium ion which is optionally substituted by $C_1$- to $C_{18}$-hydrocarbon radicals, Z is a glycosidyl radical composed of from 1 to 10 monosaccharide units, a has a value 1, 2, 3, 4 or 5, b has a value from 2 to 200, and c has a value 0 or 1, with the proviso that the organopolysiloxane compounds have at least one unit of the general formulae (V) to (VII), or from organosilanes of the general formula (XII)

$$R_3SiR' \quad \text{(XII)}$$

in which

R' is a monovalent radical of general formula (VIII) and

R is a monovalent hydrocarbon radical having from 1 to 18 carbon atoms.

5. The process of claim 4, wherein a has a value of 2 or 3.

* * * * *

UNITED STATES PATENT AND TRADEMARK OFFICE

CERTIFICATE OF CORRECTION

PATENT NO. : 6,521,084 B1
DATED : February 18, 2003
INVENTOR(S) : Willibald Burger et al.

It is certified that error appears in the above-identified patent and that said Letters Patent is hereby corrected as shown below:

Title page,
Item [30], Foreign Application Priority Data, delete "Nov. 9, 1995" and insert therefor -- Nov. 10, 1994 --.

Signed and Sealed this

Twelfth Day of August, 2003

JAMES E. ROGAN
*Director of the United States Patent and Trademark Office*